US012274380B2

(12) United States Patent
Vasseur

(10) Patent No.: US 12,274,380 B2
(45) Date of Patent: Apr. 15, 2025

(54) SYSTEM FOR THE PRESENTATION OF PRODUCTS ON A RETAIL POINT COMPRISING A CARDBOARD-MADE GRID

(71) Applicant: MEDIA 6, Tremblay-en-France (FR)

(72) Inventor: Bernard Vasseur, Saint-Maur-des-Fossés (FR)

(73) Assignee: MEDIA 6, Tremblay-en-France (FR)

( * ) Notice: Subject to any disclaimer, the term of this patent is extended or adjusted under 35 U.S.C. 154(b) by 63 days.

(21) Appl. No.: 18/492,539

(22) Filed: Oct. 23, 2023

(65) Prior Publication Data

US 2024/0130542 A1 Apr. 25, 2024
US 2024/0225312 A9 Jul. 11, 2024

(30) Foreign Application Priority Data

Oct. 24, 2022 (FR) ..... 2211004

(51) Int. Cl.
*A47F 5/11* (2006.01)

(52) U.S. Cl.
CPC ..... *A47F 5/114* (2013.01); *A47F 5/118* (2013.01)

(58) Field of Classification Search
CPC .. A47F 5/11; A47F 5/112; A47F 5/114; A47F 5/118; A47F 5/0081
USPC ..... 206/763
See application file for complete search history.

(56) References Cited

U.S. PATENT DOCUMENTS 3,164,350 A * 1/1965 Taub ..... A47F 5/114 211/133.1
5,437,379 A * 8/1995 Wolf ..... A47F 5/0081 211/47
2008/0121563 A1 5/2008 Polvere et al.
2018/0293919 A1* 10/2018 Ertl ..... A47F 5/116
2021/0229857 A1 7/2021 Pintucci et al.
2021/0357836 A1* 11/2021 Gressel ..... G07F 9/023
2022/0330724 A1* 10/2022 Chow ..... B65D 5/52
2022/0391829 A1* 12/2022 Mallard ..... A47F 5/0043

FOREIGN PATENT DOCUMENTS

FR 3104793 A1 6/2021

OTHER PUBLICATIONS

French Search Report and Written Opinion dated Jun. 1, 2023, for corresponding French Application No. 2211004, filed Oct. 24, 2022.

* cited by examiner

*Primary Examiner* — Jacob K Ackun
(74) *Attorney, Agent, or Firm* — David D. Brush; Westman, Champlin & Koehler, P.A.

(57) ABSTRACT

A system for presentation of products on a retail point. The system includes: a permanent piece of furniture; at least one cardboard-made support distinct from the piece of furniture, the support bearing compartments for the products; a reversible coupling for reversibly coupling the support on the piece of furniture; at least one panelling distinct from the support, the panelling bearing a decorative display; a reversible fastener for reversibly fastening the panelling on the support.

10 Claims, 6 Drawing Sheets

[Fig. 1]
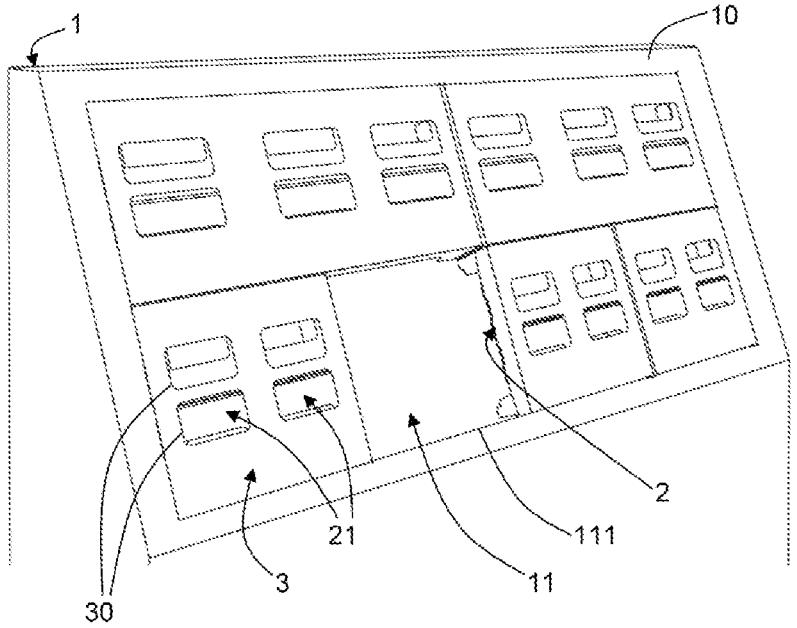

[Fig. 2]
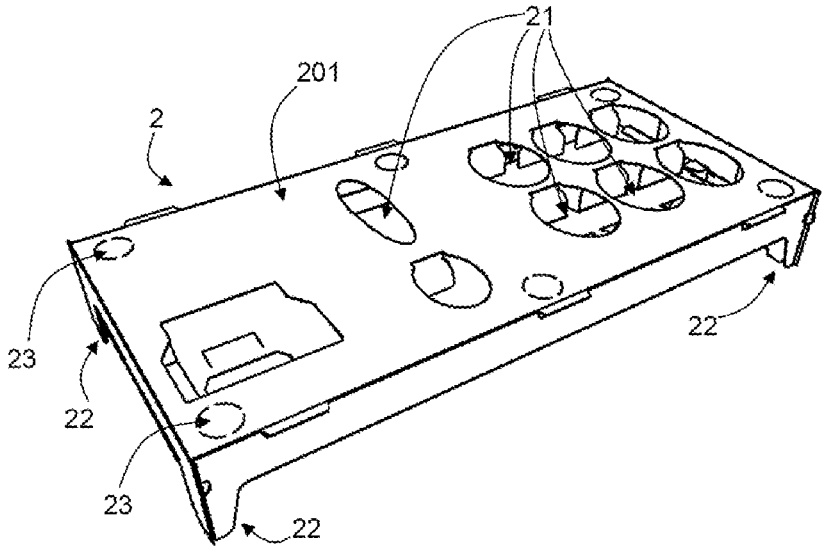

[Fig. 3]
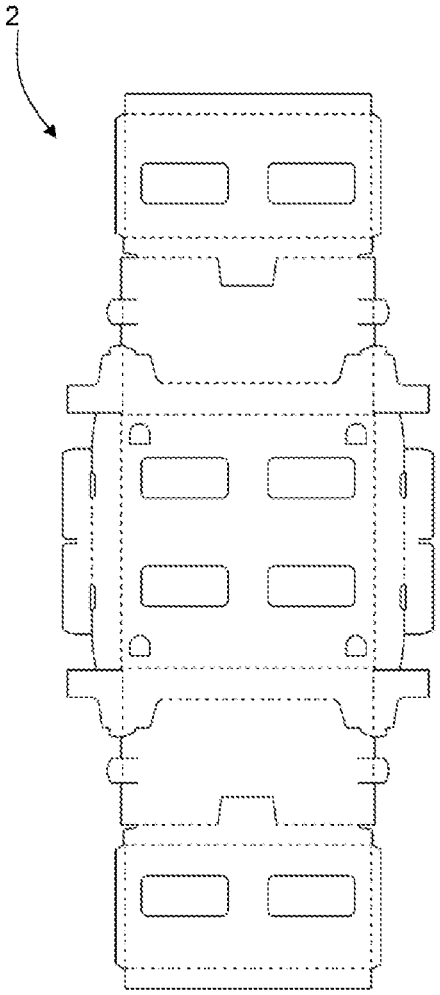

[Fig. 4]
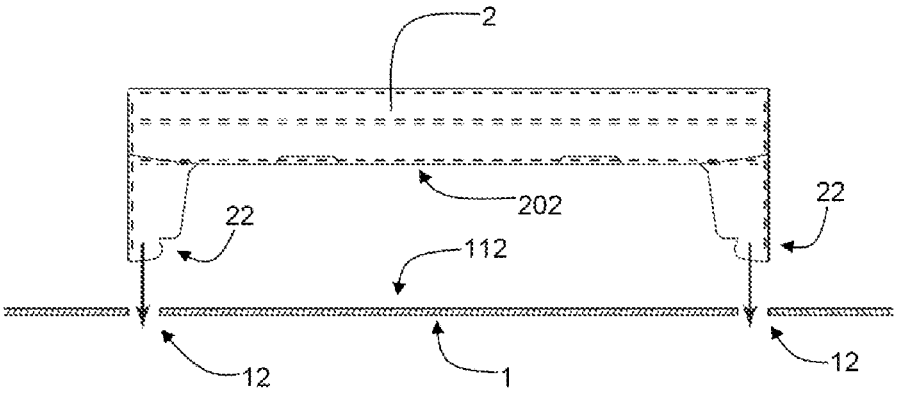

[Fig. 5]
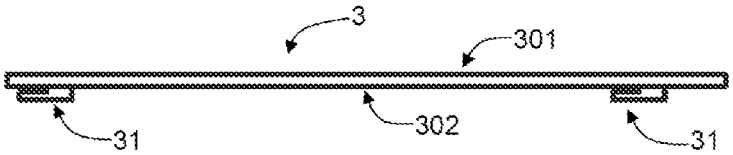

[Fig. 6]
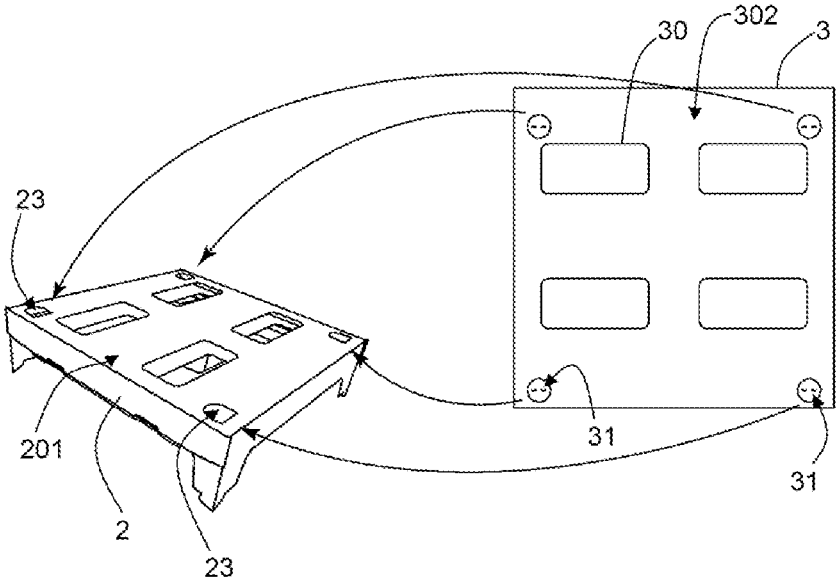

SYSTEM FOR THE PRESENTATION OF PRODUCTS ON A RETAIL POINT COMPRISING A CARDBOARD-MADE GRID

CROSS-REFERENCE TO RELATED APPLICATIONS

The present application claims priority to and the benefit of French Patent Application No. FR2211004, filed Oct. 24, 2022, the content of which is hereby incorporated by reference in its entirety.

FIELD OF THE DISCLOSURE

The present disclosure relates to the field of design and manufacture of systems allowing exhibiting products on a retail point.

More particularly, the present disclosure relates to a system implementing a presentation grid intended to receive and present products in compartments. The grid is designed so as to be integrated in a permanent piece of furniture of the retail point, itself being designed so as to receive different grids according to the sales and the evolution of the sold products.

BACKGROUND OF THE DISCLOSURE

In the field of the present disclosure, and in particular that of product presentation on a retail point, cardboard-made supports allowing exhibiting products are known.

The cardboard-made supports may basically be self-supporting and be made from an assembly of a plurality of cardboards folded on themselves so as to form a pedestal and a tray intended to receive products to exhibit them.

Such supports have a simple and inexpensive design, but have an average service life of a few months.

More quality product presentation systems are desired in retail points.

Such a presentation system type conventionally implements product presentation grids intended to be integrated in permanent pieces of furniture.

A permanent piece of furniture corresponds to a furniture on a retail point intended to remain on the retail point throughout seasons.

For example, such a permanent piece of furniture is made of wood and features quality finishes.

Such a permanent piece of furniture conventionally features rooms on its upper face, in which product presentation grids are intended to be integrated.

A product presentation grid is made of injected plastic, and may integrate different elements such as magnets or metallic fittings allowing fastening the grid in the room of the permanent piece of furniture.

These grids are quality made to allow for an aesthetically-pleasant presentation of the products.

For example, a decorative display may be glued on one of these grids to improve the aesthetics of the presentation.

The use of such grids made of injected plastic turns out to be barely ecological because of the mere nature of the material used to create them, as well as their low recyclability.

SUMMARY

An exemplary aspect of the present disclosure relates to a system for the presentation of products on a retail point, comprising a permanent piece of furniture, compartments for the products, and a decorative display, characterised in that it comprises:

- at least one cardboard-made support distinct from the piece of furniture, the support bearing the compartments on an upper face;
- means for reversible coupling of the support on the piece of furniture;
- at least one panelling distinct from the support, the panelling bearing the decorative display;
- means for reversible fastening of the panelling on the upper face of the support;

the panelling also bearing lights for each compartment of the support configured to enable the insertion of the products through the panelling into the compartments.

Thanks to the system according to an exemplary aspect of the present disclosure, a cardboard-made support and a panelling are provided the association of which allows forming a presentation grid, in particular similar to those made of injected plastic according to the prior art.

Thus, the cardboard-made support could be coupled on a permanent piece of furniture, and be replaced as it wears out, or at will with the different product collections sold on the retail point.

In addition, thanks to the reversible fastening means and the reversible coupling means, the panelling could be disassembled from the support and the support could be disassembled from the permanent piece of furniture. Consequently, the panelling could be recycled in its own recycling branch, whereas the support could be recycled in a cardboard recycling branch.

According to a preferred feature, the coupling means are of the clipping type and are formed by:

- female members borne by one amongst the piece of furniture and the support;
- male members borne by the other one amongst the piece of furniture and the support.

Such coupling means allow achieving coupling quickly and easily as a simple insertion of the male members into the female members allows achieving coupling.

Preferably, the male members are borne by the support, and the female members are borne by the piece of furniture.

By bearing the female members, the piece of furniture does not have any projecting member that might degrade as the system is used.

For example, an improper handling of elements above the piece of furniture could not result in a breakage of a foot of a member that would project from the piece of furniture.

In this case, advantageously, the male members are formed by portions of the support.

The male members are then made of cardboard.

The cardboard used to form the support also allows directly forming the male members.

Thus, the male members of the coupling means are made integrally in one-piece with the support, which allows simplifying the design of the support and facilitating recycling of the support and of the male members of the coupling means.

According to an advantageous solution, the male members are in the form of cardboard-made hooks.

Such hooks allow achieving clipping in a simple manner.

Preferably, the support is formed by folding a blank of a cardboard panel.

Such a blank of a cardboard is easy to make, and forms a means that is easy to transport on a retail point.

Shaping of the support by folding is carried out easily on the retail point, and that being so in particular by persons used to set up basic cardboard-made supports.

According to an advantageous embodiment, the fastening means are of the clipping type and are formed by:

female portions borne by one amongst the panelling and the support;

male portions borne by the other one amongst the panelling and the support.

Fastening of the panelling on the support is then carried out in a particularly simple manner.

Preferably, the female portions are borne by the support, and the male portions are borne by the panelling.

According to a preferred solution, the male portions project from a rear surface of the panelling configured to be pressed against the upper face of the support when the panelling is fastened on the support, the male portions being fully inserted into the support through the female portions.

In this manner, the panelling perfectly covers the upper surface of the support, thereby improving the perceived quality of the system.

According to a preferred design, the piece of furniture has on an exhibition façade a recess configured to accommodate at least one support with some clearance.

In this manner, the support(s) is/are fitted into the recess of the piece of furniture, and is/are better integrated in the piece of furniture.

BRIEF DESCRIPTION OF THE DRAWINGS

Other features and advantages of the present disclosure will appear more clearly upon reading the following description of embodiments of the disclosure, given as illustrative and non-limiting examples, and from the appended drawings wherein:

FIG. 1 is a schematic perspective top illustration of a portion of the product presentation system according to an aspect of the present disclosure, comprising a permanent piece of furniture, and of the cardboard-made supports accommodated in a recess of the permanent piece of furniture, the supports being covered by panelling;

FIG. 2 is a schematic perspective top illustration of a cardboard-made support of the presentation system according to an aspect of the present disclosure;

FIG. 3 is a schematic illustration of a support in a flat-laid configuration;

FIG. 4 is a schematic illustration illustrating a reversible coupling of a support on a piece of furniture of the system;

FIG. 5 is a schematic side view illustration of a panelling of the presentation system; and FIG. 6 is a schematic illustration illustrating a reversible fastening of a panelling on a support.

DETAILED DESCRIPTION OF ILLUSTRATIVE EMBODIMENTS

Referring to FIG. 1, a product presentation system, according to an aspect of the present disclosure, is shown. The system is intended to be used in a retail point.

The system comprises:

a permanent piece of furniture 1;

at least one cardboard-made support 2 distinct from the piece of furniture 1;

at least one panelling 3 distinct from the support 2.

As shown in FIG. 1, an upper portion of the permanent piece of furniture 1 is shown.

This permanent piece of furniture 1 comprises an exhibition façade 10 on which products are intended to be exhibited.

This exhibition façade 10 is substantially planar.

The piece of furniture 1 has a recess 11 on this exhibition façade 10.

This recess 11 forms a cuboid (or rectangular parallelepipedal) volume.

The recess 11 is delimited by a rectangular shaped periphery 111.

The recess 11 is configured to accommodate a plurality of supports 2 with some clearance.

According to another embodiment which is not shown, the permanent piece of furniture 1 may have a recess 11 configured to accommodate one single support 2 with some clearance.

According to still another embodiment which is not shown, the permanent piece of furniture 1 may have a plurality of recesses 11 each configured to accommodate one single support 2, or a plurality of supports 2, with some clearance.

Referring to FIGS. 1, 2, 3, 4 and 6, a cardboard-made support 2 of the system is now described.

The support 2 is made only of cardboard.

Thus, the support 2 is easily recyclable in a cardboard recycling branch.

The support 2 has compartments 21.

More specifically, the support 2 has an upper face 201 on which the compartments 21 are open.

These compartments 21 are designed so as to enable the presentation of products.

To this end, the compartments 21 are designed specifically for the products to be sold. Each of the compartments 21 has a shape with a partial imprint of the product to be sold. If a product has to be presented positioned upright and the support is intended to be horizontal, then the compartment 21 is designed so as to hold the base of the product.

As illustrated in FIG. 2, the support 2, ready to be used, has a substantially cuboid shape.

As detailed later on, the system comprises at least one reversible coupling for reversibly coupling the support 2 on the piece of furniture 1

According to the present embodiment, the at least one reversible coupling is of the clipping type. In other words, the insertion of the support 2 according to at least one predetermined direction on the piece of furniture 1, and in particular into the recess 11, enables clipping of the support 2 on the piece of furniture 1.

According to the present embodiment, and referring to FIGS. 2 and 4, the couplings comprise female members 12 and male members 22. The male members 22 couple complementarily with the female members 12.

Still according to the present embodiment, the support 2 bears the male members 22, and the female members 12 are borne by the piece of furniture 1.

As shown in FIG. 4, the male members 22 are in particular in the form of hooks which are made of cardboard.

According to the present embodiment, the male members 22 are formed by portions of the support 2.

Referring to FIG. 3, a flat-laid shape of the support 2 is illustrated.

Indeed, the support 2 is formed by folding of a blank of a cardboard.

This blank is illustrated in FIG. 3 by black continuous lines of the cardboard whereas the dotted lines illustrate predetermined folds allowing forming the entire support 2.

According to another possible embodiment, the support 2 could be made from an assembly of a plurality of cardboard-made flaps, for example by gluing, and the cardboard-made hooks would, for example, be attached on the support 2 by gluing.

Referring to FIG. 4, the female members 12 are borne in particular on the bottom 112 of the recess 11, whereas the male members 22 project from a lower face 202 of the support 2.

In this case, these female members 12 are in the form of openings through which the hooks forming the male members 22 are inserted and hooked.

According to another possible embodiment, the female members 12 could be borne by the support 2 whereas the male members 22 would be borne by the piece of furniture 1.

Referring to FIGS. 1, 5 and 6, and as mentioned before, the system comprises a panelling 3 which is distinct from the support 2.

This panelling 3 features a decorative display intended to improve the aesthetics of the product presentation system, and in particular around the products accommodated in the compartments 21.

In this case, the panelling 3 is in the form of a board having a front surface 301 intended to present the decorative display, and a rear surface 302.

The panelling 3 has apertures 30 for each compartment 21 of the support 2.

These apertures 30 are configured on the panelling 3 to enable the insertion of the products through the panelling 3 into the compartments 21.

The system further comprises at least one reversible fastener for reversible fastening of the panelling 3 on the upper face 201 of the support 2.

According to the present embodiment, and similarly to the coupling, the fasteners are of the clipping type.

These fasteners are formed by:

female portions 23 borne by the support 2;

male portions 31 borne by the panelling 3.

According to another possible embodiment which is not shown, the female portions 23 could be borne by the panelling 3, whereas the male portions 31 would be borne by the support 2.

As shown in FIG. 5, the male portions 31 project from the rear surface 302 of the panelling 3.

The rear surface 302 of the panelling 3 is configured to be pressed against the upper face 201 of the support 2 when the panelling 3 is fastened on the support 2.

In this case, the male portions 31 of the fasteners are fully inserted into the support 2 through the female portions 23.

In the present embodiment, the panelling 3 is plastic board and the male portions 31 of the fasteners are made integrally in one-piece with the plastic board.

According to another possible embodiment, the panelling 3 is a cardboard.

In particular, these male portions 31 are in the form of hooks.

In turn, the female portions 23 are in the form of holes formed on the upper face 201 of the support 2, designed so as to enable the insertion and hooking of the male portions 31.

During the installation of the system, the support 2, according to the sent embodiment, is inserted and hooked into the recess 11 of the piece of furniture 1.

Afterwards, the panelling 3 is hooked on the support 2.

Advantageously, the panelling 3 is flush with the exhibition façade 10 of the piece of furniture 1.

Nonetheless, it may consist of the upper face 201 of the support 2 which is flush with the exhibition façade 10 of the piece of furniture 1, and the panelling 3 then products from the exhibition façade 10.

In this case, the panelling 3 may be designed so as to lie over the exhibition façade 10 in order to improve the perceived quality of the system.

The products could then be inserted into the compartments 21 of the support 2.

When the support 2 is no longer suited to the products to be sold, all it needs then is to change the panelling 3 and the support 2, by unclipping them respectively from the support 2 and from the piece of furniture 1.

An exemplary aspect of the present disclosure overcomes at least some of the drawbacks of the prior art.

More particularly, an exemplary aspect provides a system for the presentation of products on a retail point which has a better ecological footprint than conventional presentation systems implementing a grid made of injected plastic.

In particular, an exemplary aspect of the present disclosure provides such a system that allows for a better recycling of its materials than that according to the prior art.

Although the present disclosure has been described with reference to one or more examples, workers skilled in the art will recognize that changes may be made in form and detail without departing from the scope of the disclosure and/or the appended claims.

What is claimed is:

1. A system for presentation of products on a retail point, the system comprising:

a permanent piece of furniture;

compartments for the products;

at least one cardboard-made support distinct from the piece of furniture, the support bearing the compartments on an upper face;

a reversible coupling, which reversibly couples the support on the piece of furniture;

at least one panelling distinct from the support, the at least one panelling bearing a decorative display;

a reversible fastener, which reversibly fastens the panelling on the upper face of the support;

the panelling also bearing at least one light for each compartment of the support configured to enable insertion of the products through the panelling into the compartments.

2. The system according to claim 1, wherein the reversible coupling comprises a clip formed by:

at least one female member borne by one of the piece of furniture or the support;

at least one male member borne by the other of the piece of furniture or the support.

3. The system according to claim 2, wherein the at least one male member is borne by the support, and the at least one female member is borne by the piece of furniture.

4. The system according to claim 3, wherein the at least one male is formed by portions of the support.

5. The system according to claim 2, wherein the at least one male member comprises a cardboard-made hook.

6. The system according to claim 1, wherein the support comprises a folded blank of a cardboard panel.

7. The system according to claim 1, wherein the reversible fastener comprises a clip formed by:

at least one female portion borne by one of the panelling or the support;

at least one male portion borne by the other of the panelling or the support.

8. The system according to claim 7, wherein the at least one female portion is borne by the support, and the at least one male portion borne by the panelling.

9. The system according to claim 8, wherein the at least one male portion projects from a rear surface of the panelling and is configured to be pressed against the upper face of the support when the panelling is fastened on the support, the at least one male portion being fully inserted into the support through the at least one female portion.

10. The system according to claim 1, wherein the piece of furniture has an exhibition façade and a recess on the exhibition façade configured to accommodate the at least one cardboard-made support with some clearance.

* * * * *